US007159425B2

(12) United States Patent
Prevey et al.

(10) Patent No.: US 7,159,425 B2
(45) Date of Patent: Jan. 9, 2007

(54) METHOD AND APPARATUS FOR PROVIDING A LAYER OF COMPRESSIVE RESIDUAL STRESS IN THE SURFACE OF A PART

(76) Inventors: Paul S. Prevey, 6325 Hunters Trail, Cincinnati, OH (US) 45246; John T. Cammett, 341 Creedmoor Rd., Jacksonville, NC (US) 28546

( * ) Notice: Subject to any disclaimer, the term of this patent is extended or adjusted under 35 U.S.C. 154(b) by 178 days.

(21) Appl. No.: 10/944,545

(22) Filed: Sep. 17, 2004

(65) Prior Publication Data

US 2005/0039511 A1 Feb. 24, 2005

(30) Foreign Application Priority Data

Mar. 14, 2003 (US) ..... PCT/US03/08130

(51) Int. Cl.
*B24C 1/10* (2006.01)
*C21D 7/06* (2006.01)

(52) U.S. Cl. ..... 72/53; 29/90.7; 451/39

(58) Field of Classification Search ..... 72/53; 29/90.7; 451/39

See application file for complete search history.

(56) References Cited

U.S. PATENT DOCUMENTS

| | | | | |
|---|---|---|---|---|
| 3,844,846 | A * | 10/1974 | Friske et al. | 72/53 |
| 3,950,642 | A * | 4/1976 | Feld | 72/53 |
| 4,426,867 | A * | 1/1984 | Neal et al. | 72/53 |
| 5,240,520 | A * | 8/1993 | Tarui et al. | 72/53 |
| 5,592,841 | A * | 1/1997 | Champaigne | 72/53 |
| 5,816,088 | A * | 10/1998 | Yamada et al. | 72/53 |
| 6,449,998 | B1 * | 9/2002 | Takeda et al. | 72/53 |
| 6,694,789 | B1 * | 2/2004 | Yamamoto et al. | 72/53 |

* cited by examiner

*Primary Examiner*—David B. Jones
(74) *Attorney, Agent, or Firm*—Smith Brandenburg Ltd.; Mark F. Smith; Brian A. Tent

(57) ABSTRACT

The shot peening method and apparatus (FIG. 13) of the present invention utilizes control of the shot peening coverage to provide higher surface compression and comparable depth of compression to conventional 100% coverage peening but with reduced cold working providing improved thermal stability and reduction in shot peening time and cost. A preferred embodiment of this invention employs x-ray diffraction (FIG. 13) residual stress and percent cold work determinated by line broadening to establish the optimal degree of coverage for a given material and shot peening intensity.

21 Claims, 13 Drawing Sheets

*The small white bar in each photograph represents 0.25 mm (0.01 in.)*

Inconel 718 Shot Peened Coupons
70 psi, 3 lb/min., 3/16 in. Nozzle @ 80 deg. (12 in. Height)

Inconel 718 Shot Peened Coupons
70 psi, 3 lb/min., 3/16 in. Nozzle @ 80 deg. (12 in. Height)

Inconel 718 Shot Peened Coupons
70 psi, 3 lb/min., 3/16 in. Nozzle @ 80 deg. (12 in. Height)
Thermally Exposed at 525C for 10 hrs Inconel 718 Shot Peened Coupons
70 psi, 3 lb/min., 3/16 in. Nozzle @ 80 deg. (12 in. Height)
Thermally Exposed at 525C for 10 hrs

METHOD AND APPARATUS FOR PROVIDING A LAYER OF COMPRESSIVE RESIDUAL STRESS IN THE SURFACE OF A PART

TECHNICAL FIELD

This invention relates to a method and an apparatus of providing a layer of compressive residual stress in the surface of a part and, more particularly, to an improved and novel method and apparatus of shot peening.

BACKGROUND

Surface residual stresses are widely known to have a major effect upon fatigue and stress corrosion performance of metallic parts. Residual stresses, such as tensile residual stresses, add to the applied stresses imposed on a part in service and can lead to more rapid fatigue or stress corrosion failure. Compressive residual stresses have been shown to have the effect of countering applied tension and have been used to generally improve the life of a part by reducing its overall stress state and by retarding fatigue and stress corrosion crack initiation and growth. A variety of surface enhancement methods, such as shot peening, gravity peening, laser shocking, deep rolling, low plasticity burnishing, split sleeve cold expansion and similar mechanical treatments, have been developed to induce a beneficial layer of compressive residual stress along the surface of a part. The depth and magnitude of such residual stress and diffraction peak broadening distributions produced by such surface enhancement treatments are typically measured using x-ray diffraction methods.

Shot peening has been commonly used in industry, particularly in the automotive and aerospace industries, as the preferred method of inducing compressive stress in the surface of a part. During the shot peening process, metallic, glass, or ceramic pellets are projected, mechanically or through air pressure, such that they impinge on the surface of a work piece. The parameters used to shot peen the work piece are selected by determining the time required to achieve a specified "Almen intensity" which is determined from arc heights representing the deflection due to residual stresses induced in a thin standard steel Almen strip. The "coverage" of the shot peening process is determined by examination of the surface of the work piece at magnification to ensure that essentially the entire surface has been impacted at least once by projected pellets. This condition of an entirely impacted surface is defined to be 100% coverage and is achieved by shot peening using fixed peening parameters in a measured time as designated herein as 1T. For a given peening apparatus and peening parameters (including shot size, hardness and flow rate), the shot peening processing time to achieve a fixed percent coverage is commonly taken as proportional to the time required to achieve 100% coverage.

Until now, it has been believed that the surface of the work piece must be essentially entirely impacted by shot (i.e. entirely covered by impact craters or dimples) during the shot peening process and shot to at least 100% coverage in order to achieve a consistent and desirable depth and magnitude of residual compression. Indeed, many military and industrial shot peening standards recommend shot peening to a minimum of 100% coverage, and often require 125% to 200% coverage, in order to achieve reliable fatigue and stress corrosion life improvement. Most of the published fatigue data supporting the 100% minimum coverage has been developed using fully reversed axial loading or bending with a stress ratio (R=Smin/Smax) of −1.0.

Unfortunately, it has been shown that such conventional shot peening induces a high degree of surface deformation and cold working which increases with increasing shot peening coverage. This relatively large amount of cold working leaves the surface susceptible to rapid thermal relaxation. Further, such cold working has also been found to increase the yield strength of the surface and leaves the residual stress layer within the surface susceptible to mechanical relaxation in the event of deformation following shot peening.

Accordingly, a need exists for a method for shot peening the surface of a part to induce a layer of residual compressive stress therein to improve the part's fatigue and stress corrosion performance and also renders the surface less susceptible to thermal and mechanical relaxation than parts treated by convention shot peening.

DISCLOSURE OF THE INVENTION

The present invention is a new and novel method and apparatus of providing a layer of compressive residual stress in the surface of a part and, more particularly, provides an improved and novel method and apparatus of shot peening that induces a desired amount of residual compressive stress within the surface of the part that is less susceptible to thermal and mechanical relaxation than that obtained with convention shot peening. Further, the present invention is a new and novel method and apparatus of shot peening that provides the required compressive residual stress magnitude and depth as well as fatigue strength as provided by conventional shot peening processes, but with reduced processing times and reduced cold working.

In a preferred embodiment of the invention x-ray diffraction determinations of residual stress and line broadening measurements of cold work are used to determine the minimal amount of coverage required to achieve a desired depth and magnitude of compression with a minimal amount of processing time and surface cold working.

In another preferred embodiment of the invention the novel method of the present invention utilizes the steps of determining the depth and magnitude of compressive residual stress and the percent of cold working by x-ray diffraction for a range of shot peening coverage; developing the shot peening parameters, including Almen intensity and coverage for a given shot peening operation necessary to induce the desired compressive residual stress and surface cold working; and determining the shot peening time required to achieve the desired Almen intensity and coverage.

In another preferred embodiment of the invention, the shot peening time required to achieve the desired coverage is determined using low magnification optical examination of the surface.

In another preferred embodiment of the invention, the method includes using test coupons or actual components shot peened with a range of coverages from nominally less than about 10% to more than 100% to determine the required shot size, hardness, and Almen intensity.

In another preferred embodiment of the present invention, the part is shot peened for a period of time necessary to produce the minimal percent coverage for achieving the desired depth of compressive residual stress.

In another preferred embodiment of this invention the part is shot peened for the minimal amount of time needed to achieve the maximum possible surface compressive residual stress.

In another preferred embodiment of this invention the part is shot peened for a minimal amount of time and coverage to minimize the amount of surface and subsurface cold working to achieve a desired degree of thermal stability.

In another preferred embodiment of this invention the coverage employed during the shot peening process is selected to achieve a desired amount of cold working for achieving a given degree of thermal stability at a given elevated temperature.

Another preferred embodiment of the invention is an apparatus comprising means for projecting a plurality of pellets against a surface of a part; means for controlling the amount of coverage; and means for optically examining the surface of the part and means for taking residual stress and line broadening measurements along the surface of the part.

In another preferred embodiment of the invention, the apparatus further comprises means for electronically storing said measurements.

In another preferred embodiment of the invention, the means for taking residual stress and line broadening measurements along the surface of the part comprises x-ray diffraction means.

Various objects and advantages of the invention will be apparent from the following description, the accompanying drawings, and the appended claims.

BRIEF DESCRIPTION OF THE DRAWINGS

To provide a more complete understanding of the present invention and further features and advantages thereof, reference is now made to the following description taken in conjunction with the accompanying drawings, in which.

BEST MODE FOR CARRYING OUT THE INVENTION

Figure 1:
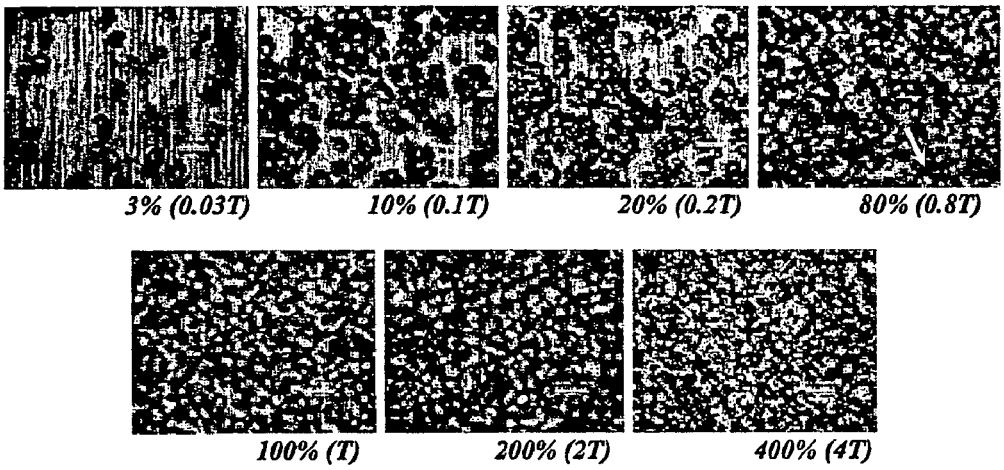
FIG. 1 represents metal surfaces that have been peened to various coverages.

The present invention is a new and novel method and apparatus for providing a layer of compressive residual stress in the surface of a part and, more particularly, to an improved and novel method of shot peening that uses x-ray diffraction residual stress and line broadening measurements of cold work to determine the minimal amount of coverage required to achieve a desired depth and magnitude of compression, such as that produced with 100% coverage, with a minimal processing time and surface cold work.

The present method utilizes a method of determining the minimum amount of shot peening coverage necessary to achieve a desired depth and magnitude of compressive residual stress with reduced surface cold work. It has been unexpectedly found that essentially the same depth of the compressive layer and even higher surface compression, can be obtained by shot peening a work piece to substantially less coverage with correspondingly shorter processing times than obtained by conventional shot peening. The method of the present invention includes determining the minimum coverage necessary for a part thus is reducing the time and cost of the shot peening process. By minimizing coverage, less cold working of the surface is achieved by reducing the number of shot impacts. It has been found that reducing the amount of cold working of the surface during the shot peening process improves the stability of the compressive layer at elevated temperatures and reduces loss of compression due to mechanical overload in the event of deformation in service.

The invention can be better understood by reference to the following illustrative examples. It should be understood that the method of the present application may be used for any metallic material having a high enough strength that fatigue and/or stress corrosion cracking would be of issue. Accordingly, the examples are meant to illustrate the invention and not to limit the scope of the invention in any way.

EXAMPLE 1

Example 1 is shown using aircraft quality 4340 steel plate (0.5 in. (1.27 cm) thick) per AMS 6359F (Aerospace Material Specification, *Society of Automotive Engineers*, United States, 1993). The material composition of 4340 steel is shown in Table 1.

TABLE 1

| Steel Composition | | | | | | | | |
|---|---|---|---|---|---|---|---|---|
| C | Mn | P | S | Si | Cr | Ni | Mo | Fe |
| 0.40 | 0.68 | 0.015 | 0.015 | 0.23 | 0.79 | 1.70 | 0.23 | 95.9 |

For peening trials, specimens of 0.5 in. (1.27 cm) thick and about 33×38 mm (1.3×1.5 in.) were cut from the steel plate with the longer dimension oriented along the rolling direction. After hardening and tempering to 38 HRC hardness, the specimens were reduced to 9.5 mm (0.375 in.) thickness by low stress grinding. Tensile properties resulting from heat treatment were 1164 MPa (169 ksi) ultimate tensile strength and 1089 MPa (158 ksi) 0.2% offset yield strength.

EXAMPLE 2

Example 2 is shown using nickel based super alloy IN718 plate (0.5 in. (1.27 cm) thick. The material composition of IN718 is shown in Table 2.

TABLE 2

| IN718 Composition (%) | | | | | | |
|---|---|---|---|---|---|---|
| Ni | Cu | Fe | Cb + Ta | Mo | Ti | Al |
| 53.0 | 18.0 | 18.0 | 5 | 3.0 | 1.0 | 0.5 |

For peening trials, specimens of 0.5 in. (1.27 cm) thick and about 33×38 mm (1.3×1.5 in.) were cut of the IN718 plate with the longer dimension oriented along the rolling direction. After solution treated and aged to 44–45 HRC hardness, as typically done for use at elevated temperature high strength applications, such as in engine applications, the specimens were then reduced to 9.5 mm (0.375 in.) thickness by low stress grinding. Tensile properties resulting from heat treatment were 1192 MPa (173 ksi) ultimate tensile strength and 1433 MPa (208 ksi) 0.2% offset yield strength.

Peening for both Example 1 and Example 2 were performed using direct air pressure at 482 kPa (70 psi.) through a single 4.7 mm (3/16 in.) diameter nozzle aligned to give an 80-degree incidence angle from horizontal. Specimens were mounted on a rotary table running at 6 RPM at a vertical distance of 305 mm (12 in.) from the nozzle outlet. Carbon steel CCW14 conditioned cut wire shot was used at a controlled flow rate of 1.36 kg/min (3 lb/min). The intensity achieved was 0.22 mm A (0.009 in. A). Coverage was then determined by optical observation at 20× magnification. The time to achieve 100% coverage was defined as the peening exposure time at which essentially no undimpled areas remained in an approximately 2.5 cm (1.0 in.) square area in the center of the specimens. Undimpled areas were easily observed using surface texture contrast between the original ground surface and shot impacted areas. Fractional and multiple coverages were taken as ratios of the time for 100% coverage.

As used herein, coverage is defined in terms of the fraction of area impacted. Assessing coverage as the fraction of the area impacted using optical examination is inherently subjective, but does include the effect of the work piece mechanical properties, and is the method adopted by most shot peening standards (Aerospace Material Specifications, AMS 2403L, AMS-S-13165, *Society of Automotive Engineers*, United States 1992 and 1997; Surface Vehicle Recommended Practice, SAE J443, *Society of Automotive Engineers*, United States, 1984; Military Specifications, Shot Peening of Metal Parts, MIL-S-113165C, United States, 1989).

For the Examples, 100% coverage was achieved in 5.0 minutes (intermitted peening in the turn table) while only 2.0 minutes was required for saturation of the Almen strip under the same peening conditions (A factor of 2.5 difference). To avoid ambiguity, the number of shot impacting the sample per square mm at 100% coverage was quantified by direct measurement of total collected shot as 336 shot/mm$^2$. In the Examples, the coverage calculated from the dimple diameter and total impacts (Abyaneh, M., Kirk, D., "Fundamental Aspects of Shot Peening Coverage Control, Part Three: Coverage Control Versus Fatigue", *ICSP*6, pp. 456–463, 1996) was 99.8%.

Residual stress measurements were conventionally made using x-ray diffraction from the shift in diffraction peak position using Cr K$\alpha$ radiation (Prevey, P. S., Metals Handbook, *ASM International*, United States, 1986, v. 10, pp. 380–292; Hilley, M. E. ed., *SAE J*784, 1971; Noyen, I. C. and Cohen, J. B., Springer-Verleg, United States, NY, 1987). Subsurface data were conventionally obtained by alternately measuring the residual stress and then electropolishing to remove surface layers. This process can be automated using residual stress profiling apparatus such as disclosed in U.S. Pat. No. 5,737,385. Residual stress measurements made as a function of depth from the peened surface were corrected for relief resulting from layer removal and for penetration of the x-ray beam into the subsurface stress gradient. An irradiated area of nominally 5×5 mm (0.2×0.2 in.) was used for residual stress measurement, providing the arithmetic average residual stress over the area of an estimated 8400 shot impacts at 100% coverage. Determinations of cold work resulting from peening were conventionally made by relating diffraction peak breadths to the equivalent true plastic strains (Prevey, P. S., "The Measurement of Subsurface residual Stress and Cold Work Distributions in Nickel Base Alloys," *ASM International*, 1987, pp. 11–19). This distribution of cold work as a function of depth was obtained from diffraction peak breadth measurements and made simultaneously with the residual stress measurements.

Following residual stress and cold work determinations, specimens used in Example 1 were thermally exposed at 246° C. (475° F.) for 24 hours to simulate high temperature use typically encountered for steel. Specimens used in Example 2 were thermally exposed at 525° C. (977° F.) for 100 hours to allow relaxation such as typically encountered in an engine application. Residual stress and cold work determinations were then repeated to determine if thermally induced relaxation had incurred.

Fatigue testing in four-point bending mode was conducted, at room temperature (22° C.) for Example 1 and at 525° C. (977° F.) for Example 2, under constant load amplitude sinusoidal loading at 30 Hz and stress ratio, R=Smin/Smax, of 0.1. The R-ratio was chosen to avoid compressive overload and the resulting immediate reduction of the compression introduced by shot peening. Bending fatigue specimens were machined with a trapezoidal cross section to ensure fatigue failure from the peened surfaces. The specimen geometry and test fixturing provided a nominally 1.25 cm (0.5 in.) wide by 2.54 cm (1.0 in.) long surface area under uniform applied stress. The central gage sections of fatigue specimen test surfaces were finished by low stress grinding and peening using the same techniques as for specimens in the peening coverage trials.

Example 1 Results:

Referring to FIG. 1, representative metal surfaces are shown that have been peened, as described above, to various coverages. Defined coverage was based upon the time ratio to achieve 100% dimpling of the surface area. It should be apparent to those skilled in the art that the percent of area covered at 80% (0.8T) coverage approached that of 100% (1T) coverage. As shown, the arrow in the photograph for 0.8T identifies a relatively small undimpled area visible when viewed optically at 20× magnification. The undimpled areas of the specimens peened for less than 0.8T are obvious in appearance. The overall appearance of surfaces peened for times, 2T and 4T, did not change relative to that peened for time T.

Figure 2:
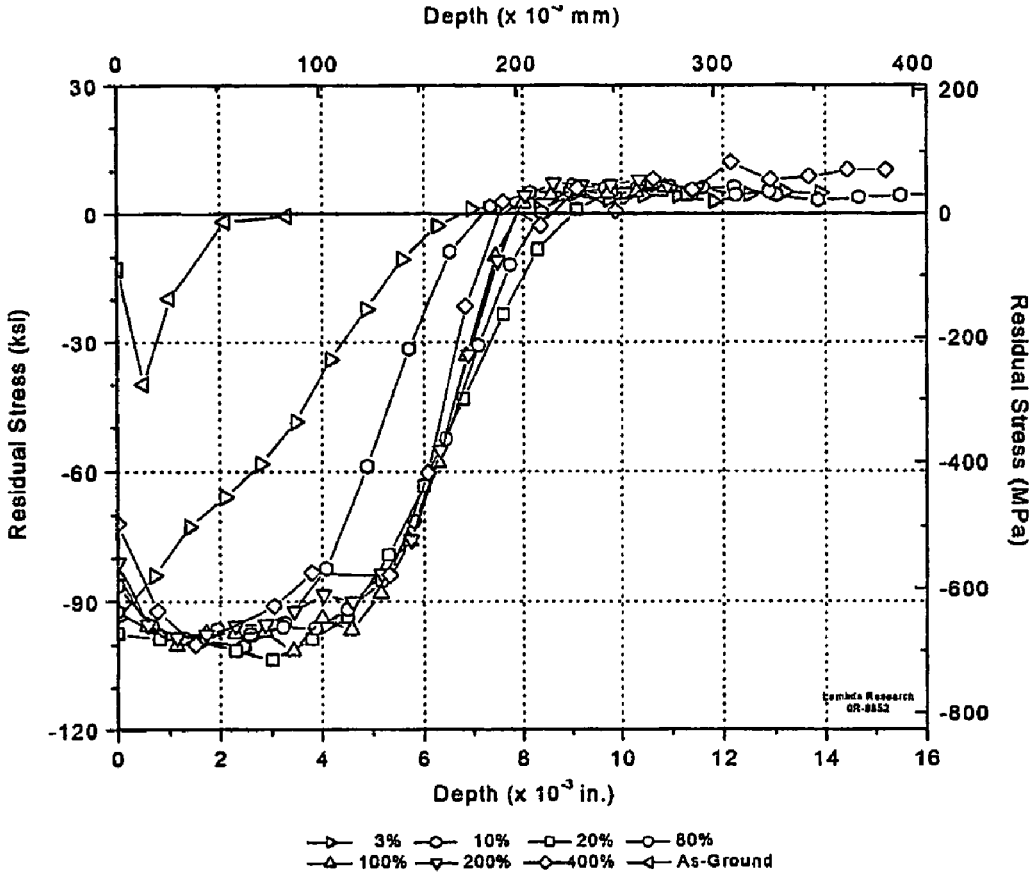
FIG. 2 illustrates surface residual stress-depth distributions for various coverage levels for shot peened 4340 steel plate before thermal exposure.

FIG. 2 illustrates the residual stress-depth distributions that were obtained in the example for the various coverage levels, including the distribution for the as ground surface before peening. Except at the lowest coverage level, 3% (0.03T), classical shot peening distributions resulted, whereby residual compressive stress magnitudes reached a subsurface maximum and decreased gradually until small tensile stresses occurred at greater depths. For 3% coverage levels, the maximum compression is shown to have occurred at the upper surface, or at a very slight depth below the upper surface. The form of the subsurface residual stress distribution for a 3% coverage level was shown to conform to finite element models of the stress developed in regions between dimples when impact areas are widely separated by twice the dimple radius (Mequid, S. A., Shagal, G. and Stranart, J. C., Analysis of Peening of Strain-Rate Sensitive Materials Using Multiple Impingement Model, *Int. J. of Impact Eng.*, 27 (2002) 119–134). Since x-ray diffraction results provide an average stress over mostly un-impacted material at the 3% coverage level, it would be apparent to one skilled in the art that the data confirms the FE prediction that even the regions between impacts are in compression. The residual stress distributions for coverage levels less than 20% (0.2T) exhibited systematic changes with coverage, whereby increasing coverage in this range resulted in increasing compressive stress magnitude at given subsurface depths and an increase in the total depth of compression. Beyond a 20% coverage level, there were no further significant changes in stress magnitude at a given depth, other than at the surface, or in total depth of compression. Surprisingly, compression at the surface tended to decrease with increasing coverage above 20%.

Figure 3:
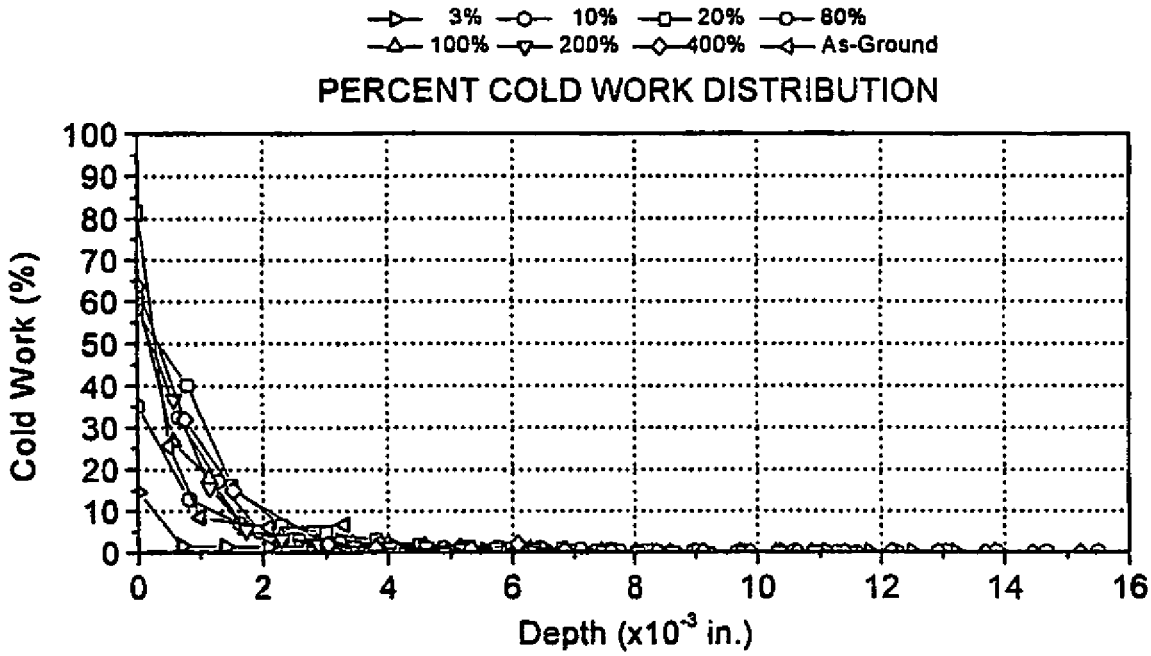
FIG. 3 illustrates surface percent cold work-depth distributions for various coverage levels for shot peened 4340 steel plate.

Referring to FIG. 3, cold work-depth distributions produced at various coverage levels of the example are shown. Consistent with residual stress-depth distributions, systematic changes in cold work-depth distributions occurred with increasing coverage-levels up to 20% (0.02T). Beyond that level, no systematic changes occurred with increasing coverage. Cold work values for the lower coverage levels were lower than at higher coverages only to a depth of about 0.05 mm (0.002 in.).

Figure 4:
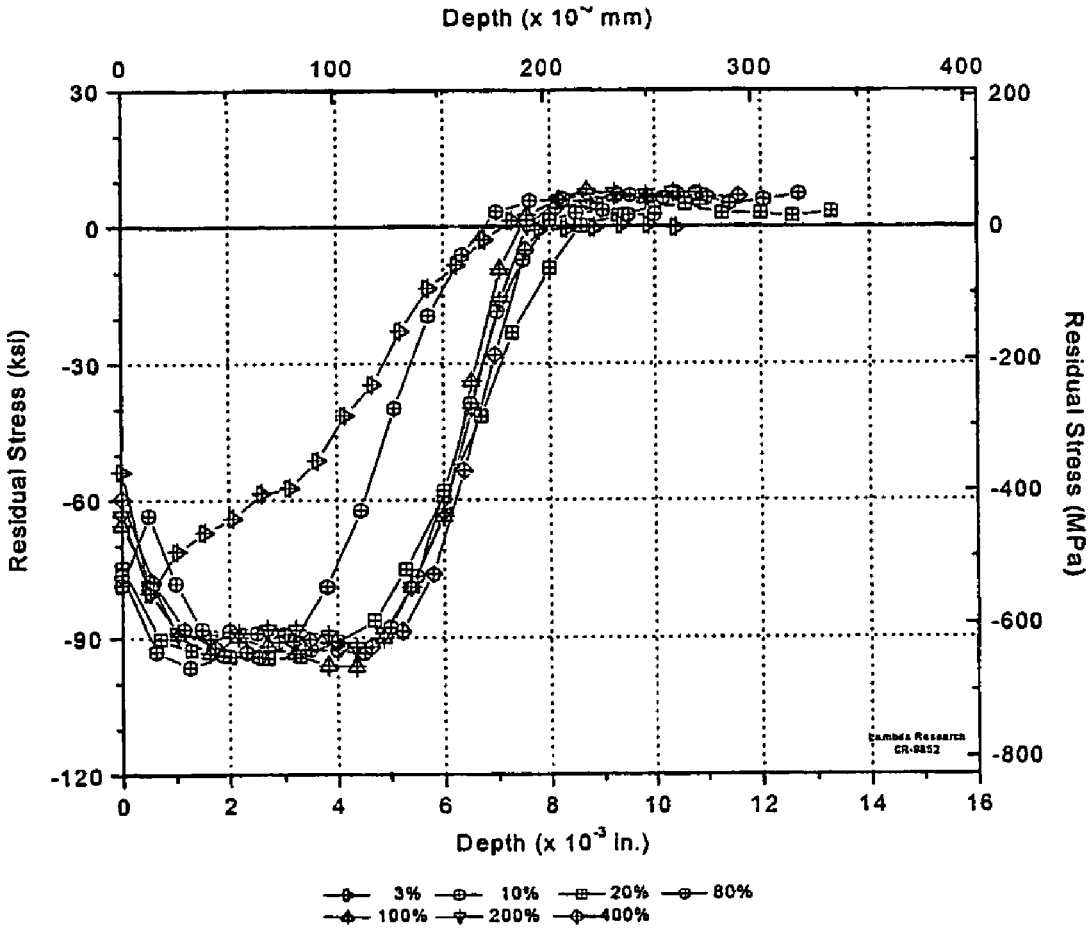
FIG. 4 illustrates surface residual stress-depth distributions for various coverage levels for shot peened 4340 steel plate after thermal exposure for 475° F. (246° C.)/24 hr.
Figure 5:
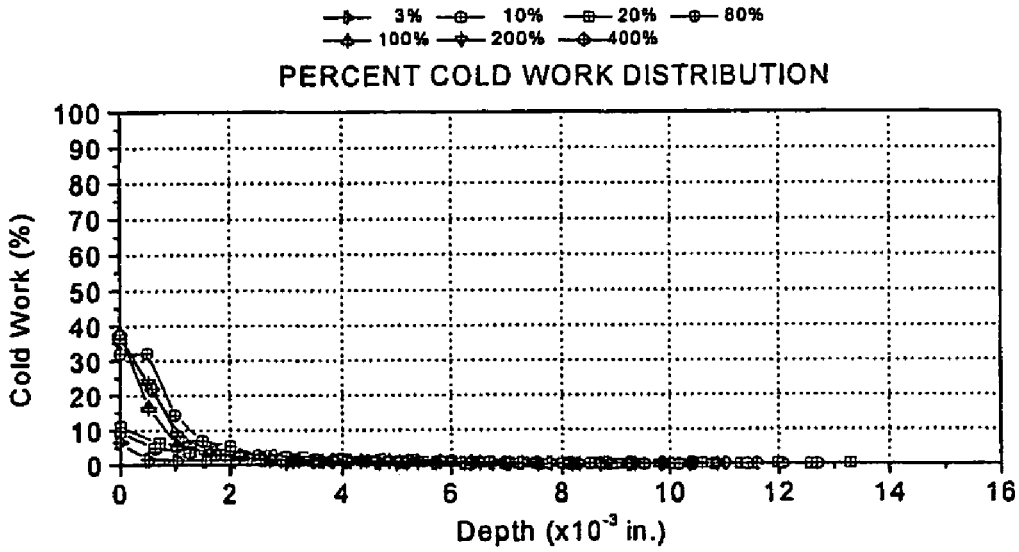
FIG. 5 illustrates cold work-depth distributions for various coverage levels for shot peened 4340 steel plate after thermal exposure.

Referring to FIGS. 4 and 5, residual stress and cold work-depth distributions obtained after thermal exposure at 246° C. (475° F.) for 24 hours are shown. The exposure temperature was chosen based upon specification AMS 13165 (Aerospace Material Specification, AMS-S-13165, *Society of Automotive Engineers*, United States, 1997) regarding maximum recommended exposure temperature to avoid residual stress relaxation in shot peened steels. Comparison with pre-exposed results (FIGS. 2 and 3) revealed changes in both residual stress magnitudes and cold work. Relaxation of both residual stress and cold work occurred at depths less than 0.05 mm (0.002 in.) with the greatest percent changes occurring in surface values. Reduction of surface residual stress magnitudes ranged from 20–30%, and percent reduction of surface cold work ranged from 40–70%. There was no systematic trend with coverage in these reductions although the reductions decreased with depth from the surface, and initial cold work level, to about 0.05 mm (0.002 in.) for all coverage levels. Beyond 0.05 mm depth, where the initial cold work level was less than nominally 5%, there were no significant changes in residual stress or cold work.

It should now be apparent to one skilled in the art that cold work from shot peening, even at less than 100% coverage, is sufficient to induce significant residual stress relaxation in surface and near surface layers at modest temperatures. Accordingly, where such reduction cannot be tolerated, surface enhancement techniques, such as low plasticity burnishing, laser shock, or coverage controlled shot peening to provide adequate compression with minimum or controlled levels of cold working may be used.

Figure 6:
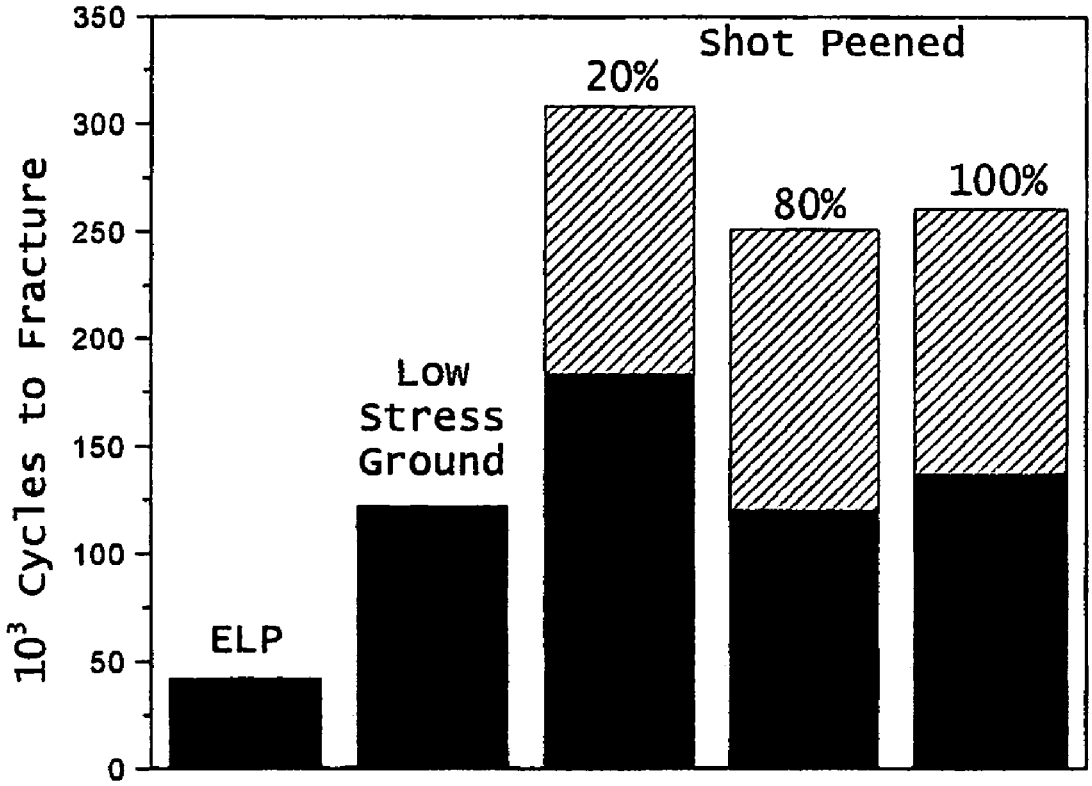
FIG. 6 illustrates bending fatigue lives at 1240 MPa (180 ksi), R=0.1, for electropolished, low stress ground and shot peened 4340 steel plate peened to the coverage indicated.

FIG. 6 shows the example results of limited initial fatigue testing. Significant surface and near surface compressive residual stresses were associated with the low stress ground condition. As shown, fatigue life for this condition was intermediate between lives for peened specimens and the electro-polished specimen ("ELP"), which had no residual stresses. Optical fractography revealed that subsurface fatigue origins occurred in all peened specimens and in the low stress ground specimen. No crack initiation sites in peened specimens were associated with undimpled surface areas irrespective of coverage. Therefore, the undimpled surface areas appear to be in compression. These results indicate the beneficial effect of peening relative to unpeened conditions. Unexpectedly, it has been found that for R>0 loading, the full benefit from peening can be realized at less than 100% coverage. This result is particularly unexpected in view of conventional teaching that fatigue life will decrease dramatically when coverage drops below 100%.

Figure 7:
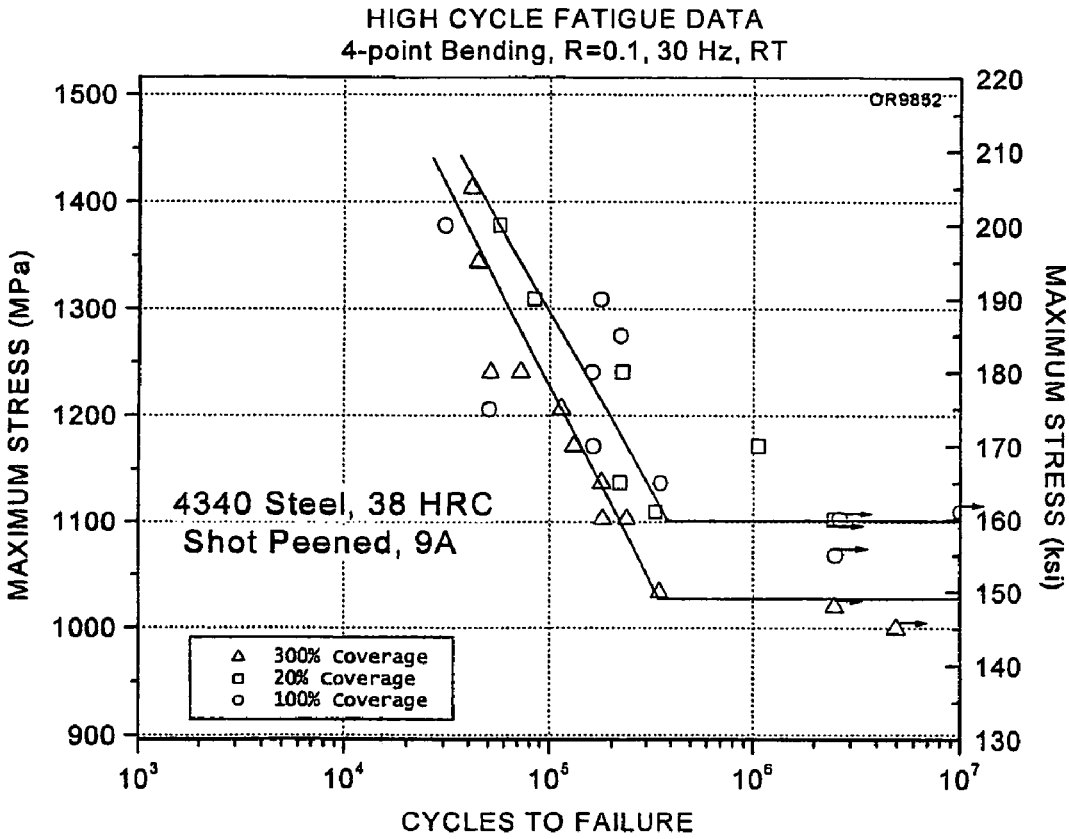
FIG. 7 illustrates high-cycle fatigue results for shot peened 4340 steel plate, 38 HRC, at 20%, 100% and 300% coverage.

S-N curves for a range of coverage were prepared to verify the unexpected finding that uniform fatigue strength is independent of coverage. Because the residual stress depths and magnitudes were found to be comparable for any coverage greater than 20%, samples were prepared with 20%, 100% and 300% coverage levels. The fatigue results, as shown in FIG. 7, surprisingly indicated that there is no loss of fatigue life or strength for coverage as low as 20%. It was found that the fatigue performances for 20% and 100% coverage levels are essentially equal given the experimental uncertainty for the limited number of samples tested. Testing also showed that a coverage level of 300% will produce consistently shorter life and a slightly lower endurance limit than coverage levels of either 100% or 20%.

When fatigue testing of shot peened surfaces is conducted in fully reversed loading, (R=−1.0), the compressive half-cycle superimposes a compressive applied stress on the already highly compressive shot peened surface. The compressive surface then yields in the first few cycles of testing resulting in rapid relaxation of the compressive surface layer. Surface residual stress measurements after fatigue testing revealed that even at alternating stress levels below the residual stress-free material endurance limit, the surface compressive stress can be reduced to 70% of the original level in the first half-cycle in fully reversed loading. Residual stress measurements on failed samples showed no significant change in surface compression after 130 and $220\times10^3$ cycles at R=0.1 and $S_{max}$ of 1240 MPa (180 ksi) for either the 100% or 20% coverage samples, respectively.

The tests performed have demonstrated that complete coverage of a workpiece is not required to produce full benefits of shot peening in 4340 steel, 38 HRC, peened to 0.22 mm (0.009 in) intensity when fatigue tested in tension-tension loading (R=0.1). A coverage level of as little as 20% (0.2T) provided fatigue performance equivalent to full coverage under conditions employed in the examples.

Figure 8:
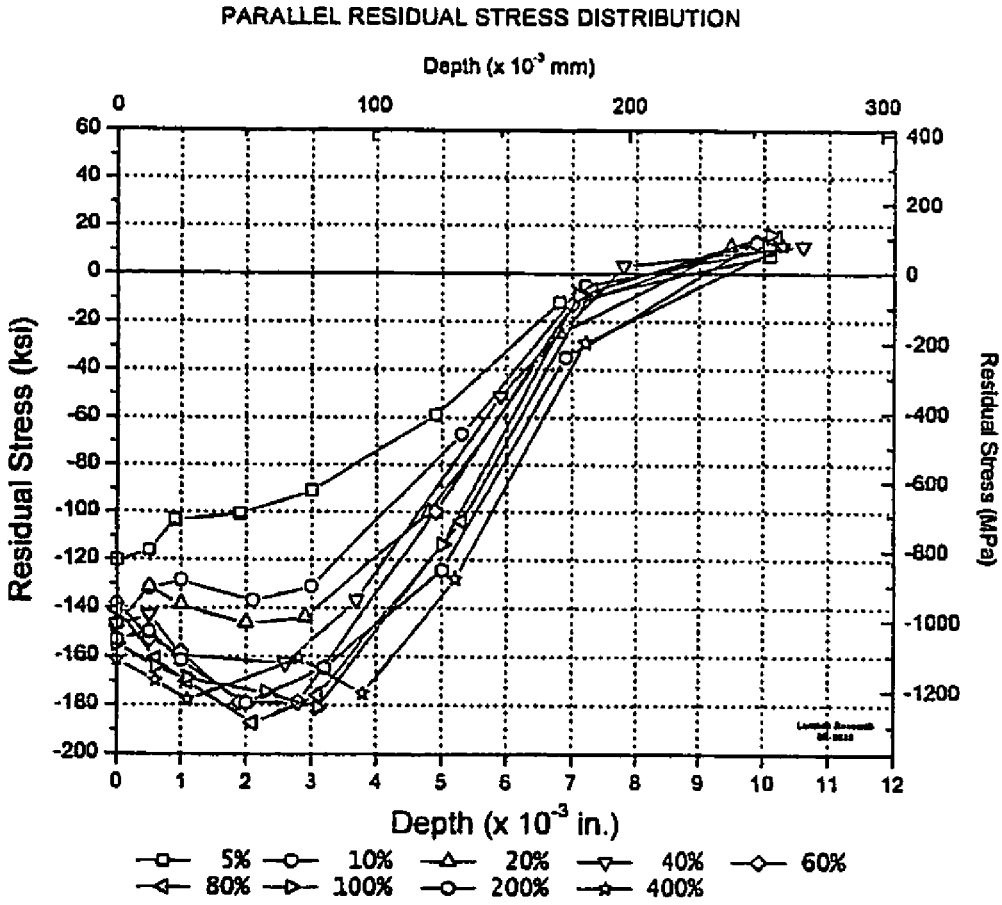
FIG. 8 illustrates surface residual stress-depth distributions for various coverage levels for shot peened IN718 plate before thermal exposure.

Example 2 Results:

FIG. 8 illustrates, the residual stress-depth distributions that were obtained in the IN718 example for the various coverage levels. As shown with Example 1, except at the lowest coverage level, 5% (0.03T), classical shot peening distributions resulted, whereby residual compressive stress magnitudes reached a subsurface maximum and decreased gradually until small tensile stresses occurred at greater depths. For 5% coverage levels, the maximum compression is shown to have occurred at the upper surface. As in Example 1, since x-ray diffraction results provide an average stress over mostly un-impacted material at the 5% coverage level, it would be apparent to one skilled in the art that even the regions between impacts are in compression. The residual stress distributions for coverage levels less than about 10% (0.1T) exhibited systematic changes with coverage, whereby increasing coverage in this range resulted in increasing compressive stress magnitude at given subsurface depths and an increase in the total depth of compression. Beyond a 10% coverage level, there were no further significant changes in stress magnitude at a given depth, other than at the surface, or in total depth of compression.

Figure 9:
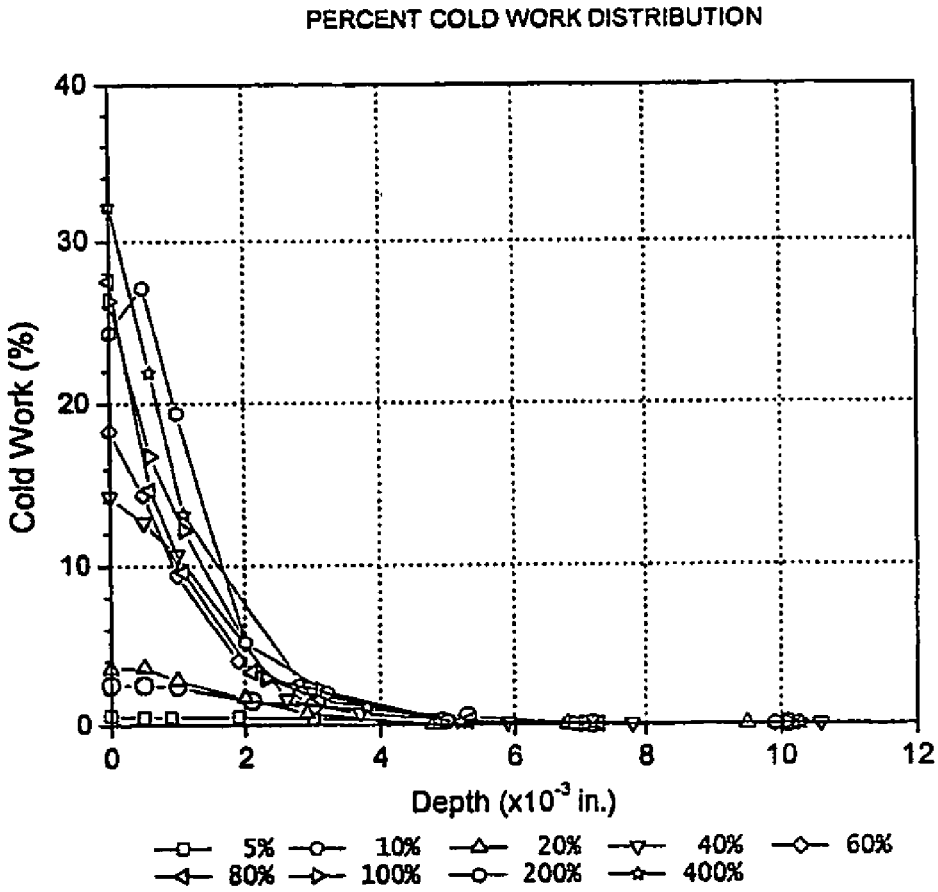
FIG. 9 illustrates surface percent cold work-depth distributions for various coverage levels for shot peened IN718 plate.
Figure 10:
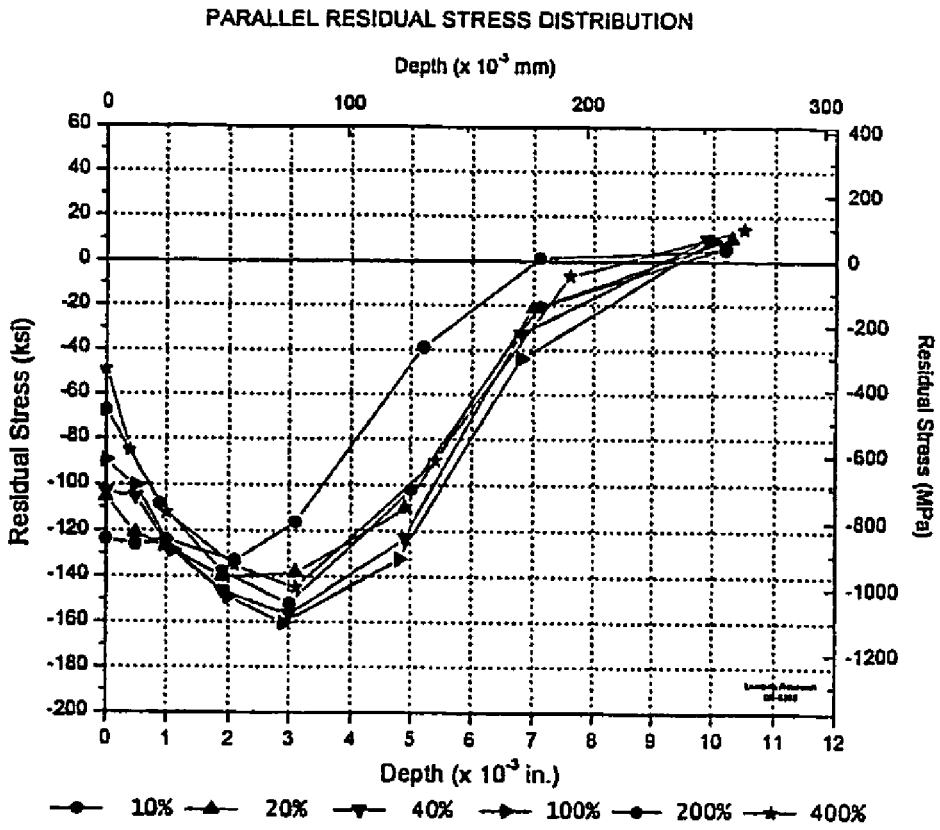
FIG. 10 illustrates surface residual stress-depth distributions for various coverage levels for shot peened IN718 plate after thermal exposure for 525° C. (977° F.)/10 hr.
Figure 11:
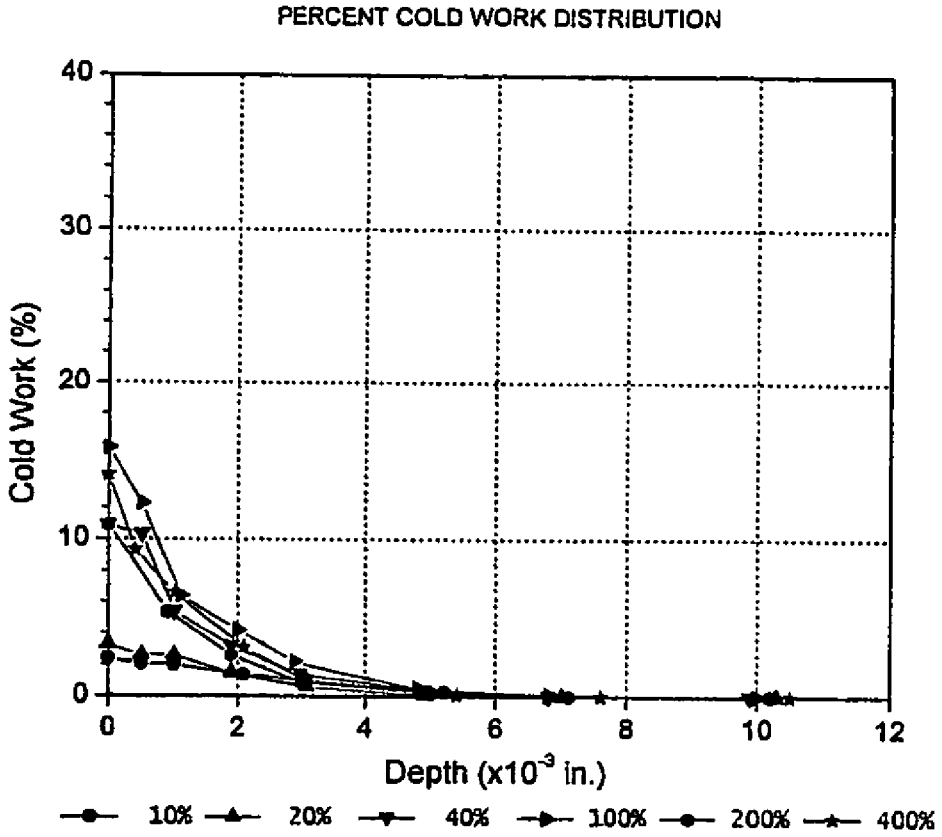
FIG. 11 illustrates cold work-depth distributions for various coverage levels for shot 525° C. peened IN718 plate after thermal exposure for 525° C. (977° F.)/10 hr.

Referring to FIG. 9, cold work-depth distributions produced at various coverage levels of the example are shown. As in Example 1, systematic changes in cold work-depth distributions to have occurred with increasing coverage levels up to 20% (0.02T). Beyond that level, no significant systematic changes occurred with increasing coverage Referring to FIGS. 10 and 11, residual stress and cold work-depth distributions obtained after thermal exposure at 525° C. (977° F.) for 10 hours are shown. The exposure temperature was chosen to simulate typical high temperature applications, such as in engine applications, often encountered with parts formed from IN718 metal. As shown, higher surface compression, nearly equal depth to 100% and with excellent thermal stability, can be obtained with just 10% coverage.

As previously shown, it should now be apparent to one skilled in the art that cold work from shot peening, even at less than 100% coverage, is sufficient to induce significant residual stress relaxation in surface and near surface layers at relatively modest temperatures. Accordingly, where such reduction cannot be tolerated, surface enhancement techniques, such as low plasticity burnishing, laser shock, or coverage controlled shot peening to provide adequate compression with minimum or controlled levels of cold working may be used.

It should also be apparent that the method of the present invention can be used for a variety of parts including nickel based super alloy turbine blades, disks, and other parts that typically operate in hot environments.

Figure 12:
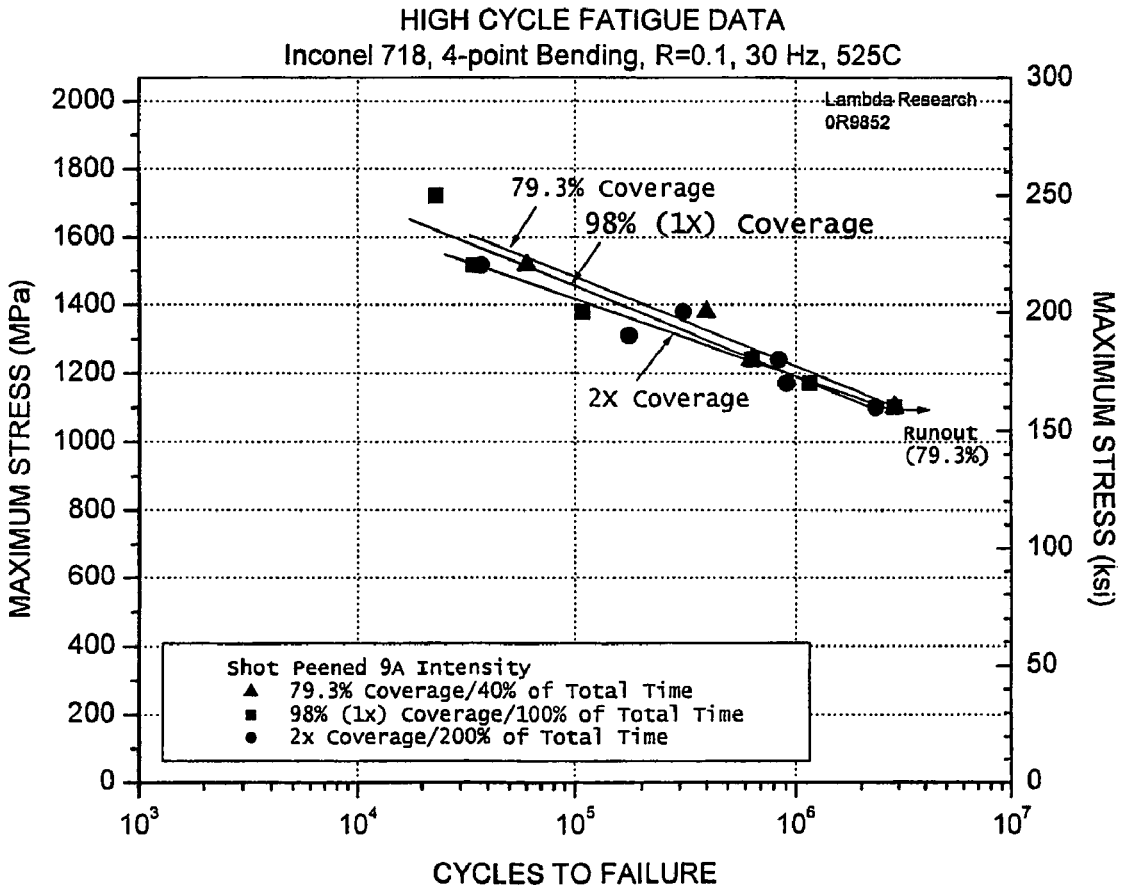
FIG. 12 illustrates high-cycle fatigue results for shot peened IN718 plate, 30 Hz, at 79.3%, 98% and 200% coverage.

FIG. 12 shows the example results of high cycle fatigue testing for peening times of about 0.4T, 1T and 2T needed for 79%, 98% and 100% coverage, respectively. As shown, the performance trends obtained for IN718 are substantially the same and indeed show better results than that demonstrated for the 4340 steel of Example 1 (FIG. 7).

Accordingly, it has been unexpectedly found during studies of the residual stress and cold work distributions produced by different amounts of coverage on a variety of steel, nickel, titanium, and aluminum alloys, that the depth and magnitude of compression generally attributed to 100% coverage can be achieved with as little as about 20% coverage in some alloys. The depth and magnitude of compression produced by 100% coverage can be essentially equaled by shot peening to much lower coverage. It has also been found that the maximum surface residual stress may be achieved at less than 100% coverage.

It should now be understood that the method of the present invention provides benefits over conventional shot peening particularly in applications where compressive overload occurs. Further, shot peening to only the reduced coverage required to achieve the necessary compression provides a means of substantially reducing the time and therefore the cost of the shot peening process. An additional benefit of the reduced coverage shot peening is less cold working of the surface during processing which is known to improve both the thermal and mechanical stability of the compressive residual stresses developed. This may be easily accomplished by using larger shot than typically used when 100% coverage is required. Such use of larger shot will provide deeper compression and reduced cold work without loss of fatigue performance as well as improved surface finish. As previously stated, reducing cold working will also provide improved thermal stability of the induced compressive layer.

The method of this invention therefore provides a means of determining the minimal percent coverage required to optimize the compressive residual stress distribution produced while minimizing the amount of cold working and the time and cost of processing.

The novel method of the present invention utilizes the steps of determining the depth and magnitude of compressive residual stress and the percent cold work, preferably by x-ray diffraction, for a range of shot peening coverage; developing the shot peening parameters, including Almen intensity and coverage for a given shot peening application; and determining the shot peening time required to achieve 100% coverage.

In a preferred embodiment of the invention, the method can include the step of using test coupons or actual components shot peened with a range of coverages, from less than about 10% to more than 100% using the shot peening apparatus, shot size, shot hardness, and Almen intensity that will be employed during the production process. It has been found that a logarithmic progression of coverage levels, such as 5%, 10%, 20%, 40%, 80%, 100%, 200% and 400% is suitable.

In another preferred embodiment of the invention, the method comprises the step of using x-ray diffraction monitoring of residual stress and cold work through diffraction peak broadening to determine the optimal coverage for a given material, shot peening size and intensity, and application.

In another preferred embodiment of the present invention the method further includes the step of inducing a layer of compressive stresses in the surface of the part by shot peening the surface for a period of time to produce the minimal percent coverage necessary to achieve the depth of compressive residual stress required.

In another preferred embodiment of this invention the method includes the step of controlling the time of shot peening and coverage to the minimum time needed to achieve the maximum possible surface compressive residual stress.

In another preferred embodiment of this invention the method includes the step of controlling the amount of coverage needed to achieve a minimum amount of surface and subsurface cold working to achieve a desired degree of thermal stability.

In another preferred embodiment of this invention the method includes the step of controlling the amount of coverage to produce not more than a certain amount of cold working in order to achieve a given degree of thermal stability at a given elevated temperature.

Figure 13:
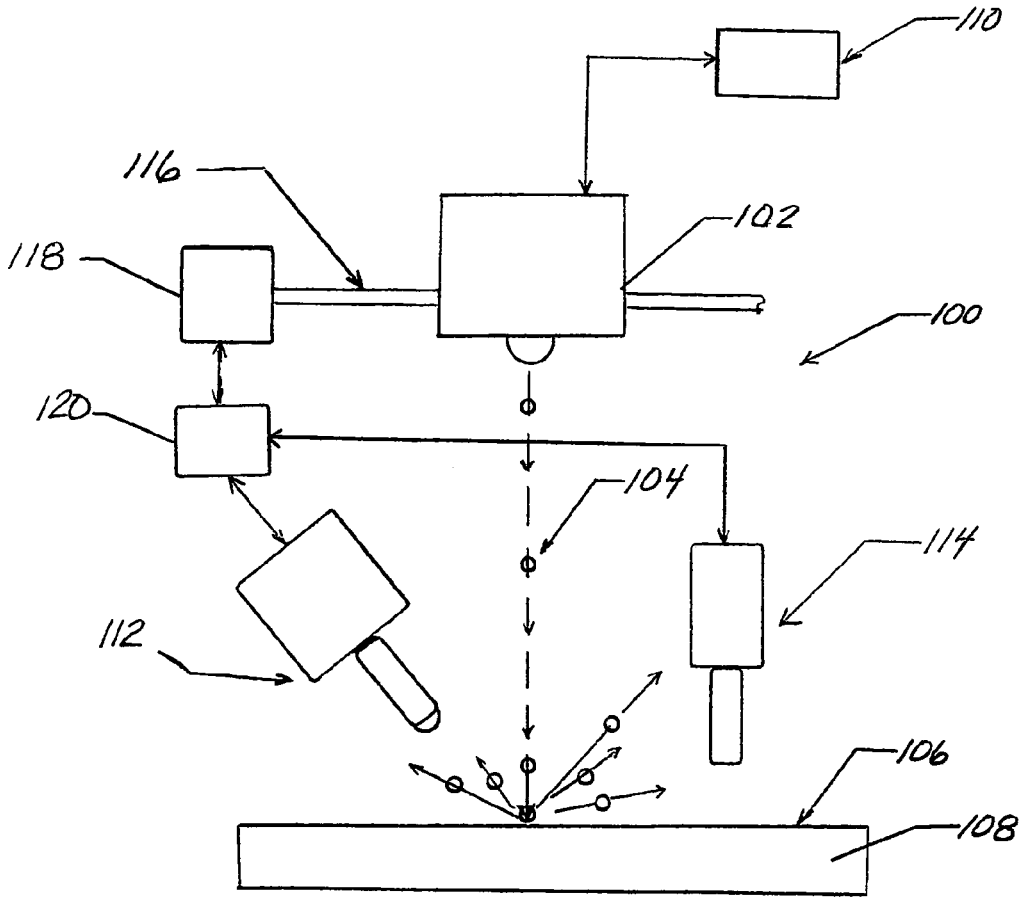
FIG. 13 is a schematic representation of the apparatus of the present invention for inducing a layer of compressive residual stress in the surface of a part.

Referring to FIG. 13 an apparatus 100 for performing the method of the invention is show comprising a projection means 102 for projecting a plurality of pellets 104 against a surface 106 of a work piece 108; means 110 for controlling the time and coverage of the pellets 104, optical means 112 for optically examining the surface 106 of the work piece 108 and; measurement means 114 for taking residual stress and line broadening measurements along the surface 106 of the work piece 108. As schematically illustrated, the projection means 102 is preferably mounted to a conventional positioning device 116 for properly positioning the projection means 102 to direct the pellets 104 against the surface 106 of the work piece 108. As previously discussed herein, the size and the material comprising the pellets 104, the force by which the pellets 104 are projected, and the amount of coverage will depend on the material forming the work piece 108 and the final application of the part and the desired penetration of the residual compressive stress induced therein. The size and material comprising the pellets 104, the projecting force, and the amount of coverage will also depend on the desired penetration of residual compressive strength and on the material composition, material properties, and dimensions of the work piece 108 and the application of the final part.

The apparatus 100 of the present invention can be manually or automatically operated. As schematically illustrated, the apparatus 100 can include a controller 118 for automatically-controlling the positioning device 116 and, thus, the direction and velocity of the pellets 104. The controller 118 can include a microprocessor, such as a computer operating under computer software control. In one embodiment, the positioning device 116 includes belt and/or gear drive assemblies (not shown) powered by servomotors (not shown), as is known in the art. The controller 118 can be in operable communication with the servomotors of the positioning device 116 through suitable wiring (not shown).

One or more sensors (not shown), including, but not limited to, linear variable differential transformers or laser, capacitive, inductive, or ultrasonic displacement sensors, which are in electrical communication with the controller 118 through suitable wiring, can be used to measure the spacing and angle of the projection means 102 above the surface of the work piece 108, and, thus, the motion of the projection 102. Similariy, shaft encoders in servo systems, stepper motor drives, linear variable differential transformers, or resistive or optical positioning sensors can be used to determine the position and projection angle of the tool along the surface 106 of the work piece 108. When inducing compressive residual stress along the surface 106 of a work piece 108, the work piece 108 is preferably secured to a work table by means of a clamp or similar device. The apparatus 100 is positioned relative to the work piece 108 such that the projection means 102 is positioned above to the surface 106 of the workpiece 108. The projection means 102 projects pellets 104 against the surface 106 of a work piece 108 to achieve the desired coverage and induce a layer of compression within the surface 106. According to another embodiment (not shown), the projection means 102 is fixed and the work piece 108 which is moved relative to the projection means 102.

According to another embodiment of the present invention, the measurement means 114 is an x-ray diffraction means. As previously disclosed conventional x-ray diffraction techniques are used to analyze the surface 106 of the work piece 108 to determine a desired coverage, penetration depth, as well as the amount of cold working and surface hardening necessary to optimize the material properties of the work piece 108. The x-ray diffraction means also operates to take residual stress and line broadening measurements along the surface of the work piece. The measurement means 114 is in electrical communication with the controller 118 and operates to relay information to the controller 118 for controlling the projection means 102.

In another preferred embodiment of the invention, the apparatus 100 further comprises memory means 120 that is in electronic communication with the optical means 112 and/or the measurement means 114 and/or the positioning device 116 for storing measurement information.

It should now be understood to those skilled in the art that the present method and apparatus provides a means for implementing a controlled shot peening method to achieve the desired magnitude and depth of compression with minimal cold working of the surface and with a minimal amount of processing time and cost. The method also permits determination of the minimal percent coverage required to produce the desired depth and magnitude of residual compression and minimal cold work for a given component, material, geometry, and application.

Accordingly, while the method and apparatus described constitutes preferred embodiment of the inventions, it is understood that the invention is not limited to the precise method and that changes may be made therein without departing from the scope of the invention which is defined in the appended claims.

The method of the subject invention further provides a novel and effective means of reducing the coverage required during conventional shot peening while retaining the beneficial depth and magnitude of compression and the corresponding benefits of improved fatigue life and reduced stress corrosion cracking. By minimizing the coverage, the time and therefore cost of shot peening processing of components can be reduced to a fraction of the current practice of using at least 100% coverage. It has been unexpectedly found, that the shot peening coverage can be reduced to the minimum amount that still provides essentially the same residual stress depth and magnitude as 100% coverage, as determined by x-ray diffraction measurement.

It has also been found that reduction of coverage to this minimal level does not reduce the fatigue performance of shot peened of steels, such as 4340 steel, and also improves the retention of compression at elevated temperatures for the nickel-based alloys, such as super alloy IN718. Accordingly, contrary to the current practice and teaching, the method of the subject invention produces a compressive layer of residual stress in the surface of a work piece while deliberately minimizing the cold working and the time and cost of such processing without degrading fatigue performance.

It should be understood to those skilled in the art that while the invention describes a process of shot peening, the, method and apparatus described herein may also be utilized with other similar processes, such as gravity, ultrasonic, and needle peening.

As previously described, the apparatus for performing the method of the invention provides means for projecting a plurality of pellets against a surface of a part; means for controlling the time and coverage of the pellets, means for optically examining the surface of the part; and means for taking residual stress and line broadening measurements along the surface of the part.

In another preferred embodiment of the invention, the apparatus further comprises means for storing said measurements.

In another preferred embodiment of the invention, the means for taking residual stress and line broadening measurements along the surface of the part comprises x-ray diffraction means.

It should now be understood to those skilled in the art that the present method and apparatus provides a means for implementing a controlled shot peening method to achieve the desired magnitude and depth of compression with minimal cold working of the surface and with a minimal amount of processing time and cost. The method and apparatus of the present invention also permits determination of the minimal percent coverage required to produce the desired depth and magnitude of residual compression and minimal cold work for a given component, material, geometry, and application.

It should also be understood that the method and apparatus of the present application can be utilized for a variety of applications, particularly for applications where components are subject to shot peening damage. Applications include parts having laps or folds that may lead to fatigue initiation, such as edges of bolt holes and bores that typically get excessively peened from multiple directions, nickel base alloy turbine disks and titanium alloy compressor and fan disks. In addition, applications may include those that are typically time and cost prohibited to shot peen to 100% coverage, such as automotive applications like connecting rods and rocker arms. The method and apparatus of the present application may also be used for applications where the use of large shot would provide deeper compression but 100% coverage would be time and cost prohibited or for applications where lower cold work provides lower generalized corrosion rates while still producing the compression required to reduce or eliminate stress corrosion cracking. Such applications include, but are not limited to, nuclear weldments, steam generator U-bends, and similar piping and welds. It should be understood however, that the method and apparatus of the present application are not limited to the above described applications.

Although this invention has been primarily described in terms of specific examples and embodiments thereof, it is evident that the foregoing description will suggest many alternatives, modifications, and variations to those of ordinary skill in the art. Accordingly, the appended claims are intended to embrace as being within the spirit and scope of the invention, all such alternatives, modifications, and variations.

What is claimed is:

1. A method of inducing compressive residual stress in the surface of a part comprising the steps of determining a depth and magnitude of compressive residual stress and percent cold work for a range of shot peening coverage for the part to be shot peened; selecting the desired shot peening time required to achieve a coverage for producing the desired depth and magnitude of the compressive residual stress and cold working for the part; and performing shot peening along the surface of the part for the desired shot peening time.

2. The method of claim 1 further comprises the step of using X-ray diffraction monitoring of residual stress and cold work through diffraction line broadening to determine the optimal coverage for a given material, shot peening size, intensity, and application.

3. The method of claim 1 wherein the amount of coverage is determined by the amount needed to achieve a minimum amount of surface cold working necessary to obtain thermally stable compressive residual stresses.

4. The method of claim 1 wherein the amount of coverage is determined by the amount of coverage needed to achieve the amount of cold working in order to obtain the desired degree of thermally stable compressive residual stresses at a given elevated temperature.

5. The method of claim 1 further comprising the step of performing X-ray diffraction of residual stress and line broadening measurements of cold worked to determine the minimal amount of coverage required to achieve a desired depth and magnitude of compression with a minimal amount of processing time and surface cold working.

6. The method of claim 1 wherein the amount of coverage is about 10% to about 100% of total coverage.

7. A method of inducing compressive residual stress in the surface of a part comprising the steps of determining a depth and magnitude of compressive residual stress and percent of cold working by X-ray diffraction for a range of shot peening coverage; developing shot peening parameters for a given shot peening operation necessary to induce a desired compressive residual stress and surface cold working; determining a shot peening time required to achieve the required coverage; and performing the desired amount of shot peening.

8. The method of claim 7 wherein the shot peening time required to achieve the desired coverage is determined using low magnification optical examination of the surface to estimate the time required to obtain the desired coverage.

9. The method of claim 7 wherein the method includes using test coupons or actual components shot peened with a range of coverages from less than about 10% to more than 100% to determine the required shot size, hardness, and Almen intensity.

10. The method of claim 7 wherein the coverage selected is the minimum coverage necessary to achieve a desired amount of cold working for achieving a given degree of thermally stable compressive residual stresses at a given elevated temperature.

11. The method of claim 7 wherein the coverage is about 10% to 100% of total coverage.

12. An apparatus for inducing compressive residual stress in the surface of a part comprising:

means for projecting a plurality of pellets against a surface of a part;

means for controlling the amount of coverage;

means for optically examining the surface of the part; and means for taking residual stress and line broadening measurements along the surface of the part.

13. The apparatus of claim 12 wherein said means for controlling the amount of coverage includes a timer means.

14. The apparatus of claim 12 further comprising X-ray diffraction means.

15. The apparatus of claim 12 further comprising means for storing said measurements.

16. A method of forming a part comprising the steps of:

selecting a portion of the part for inducing a layer of compressive residual stress therein;

selecting a desired shot peening time required to achieve a coverage for producing a desired depth and magnitude of the compressive residual stress and cold working for the part; and performing shot peening along the selected portion of the part to achieve the desired depths and magnitude of the compressive residual stress;

wherein said shot peening is performed such that the coverage is less than about 100% of said portion.

17. The method of claim 16 wherein said coverage is about 5% to 40%.

18. The method of claim 16 wherein said part is for use in an aircraft engine.

19. The method of claim 16 wherein said part is for use in a high temperature environment.

20. The method of claim 16 wherein said part is selected from the group consisting of blades for use in aircraft engines, rotor disks for use in aircraft engines.

21. The method of claim 16 wherein said part is selected from the group consisting of blades for use in aircraft engine parts, automotive engine parts, power generating parts, nuclear weldments, and steam generator U-bends.

* * * * *